US007231908B2

(12) United States Patent
Namari et al.

(10) Patent No.: US 7,231,908 B2
(45) Date of Patent: Jun. 19, 2007

(54) ENGINE START CONTROL DEVICE AND START CONTROL METHOD

(75) Inventors: Takashi Namari, Shibata-gun (JP); Tomoo Shimokawa, Yokohama (JP); Masato Ono, Utsunomiya (JP); Satoshi Chida, Utsunomiya (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 10/552,614

(22) PCT Filed: Apr. 5, 2004

(86) PCT No.: PCT/JP2004/004924

§ 371 (c)(1),
(2), (4) Date: Oct. 6, 2005

(87) PCT Pub. No.: WO2004/092563

PCT Pub. Date: Oct. 28, 2004

(65) Prior Publication Data

US 2006/0278200 A1 Dec. 14, 2006

(30) Foreign Application Priority Data

Apr. 11, 2003 (JP) ..... 2003-107795

(51) Int. Cl.
*F02D 41/06* (2006.01)
*F02N 1/00* (2006.01)

(52) U.S. Cl. ..... 123/491; 123/179.16

(58) Field of Classification Search ..... 123/179.16, 123/478, 490, 491
See application file for complete search history.

(56) References Cited

U.S. PATENT DOCUMENTS

| | | | | |
|---|---|---|---|---|
| 4,541,390 | A * | 9/1985 | Steinbrenner et al. | 123/491 |
| 4,683,859 | A * | 8/1987 | Tamura et al. | 123/491 |
| 4,907,562 | A * | 3/1990 | Johansson et al. | 123/179.5 |
| 6,575,143 | B2 * | 6/2003 | Uemura et al. | 123/490 |
| 6,854,450 | B2 * | 2/2005 | Kitagawa et al. | 123/491 |

FOREIGN PATENT DOCUMENTS

| | | |
|---|---|---|
| JP | 64-53058 | 3/1989 |
| JP | 5-126020 | 5/1993 |
| JP | 2002-106397 | 4/2002 |
| JP | 2002-206466 | 7/2002 |

* cited by examiner

*Primary Examiner*—T. M. Argenbright
(74) *Attorney, Agent, or Firm*—Squire, Sanders & Dempsey L.L.P.

(57) ABSTRACT

An engine start control device capable of starting upon receiving generated power from a generator which is driven by a starter, includes a fuel injection timing setting device which makes a power generation waveform of the generator correspond to a crank pulse signal, and outputs a fuel injection signal to an injector for injecting fuel to the engine in conformance with a crank pulse signal for when a voltage of the generated power reaches a peak value after a starting operation of the starter.

3 Claims, 3 Drawing Sheets

ENGINE START CONTROL DEVICE AND START CONTROL METHOD

TECHNICAL FIELD

The present invention relates to an engine start control device and a start control method. Basic application of the present application is Japanese Patent Application No. 2003-107795, the contents of which are incorporated herein by reference.

BACKGROUND ART

Heretofore, battery-less fuel injectors for multiple cylinder internal combustion engines, which avoid excess load on a generator when the engine starts, are known (for example, refer to Japanese Unexamined Patent Application, First Publication No. 2002-106397). In such battery-less fuel injectors, after the internal combustion engine is started by a recoil starter or a kick starter, in the case where it is not clear from which cylinder a crank pulse signal output from a signal generator derives, fuel is injected to each of the cylinders in a predetermined order each time a reference pulse signal is generated.

However, in the above-described conventional technique, although fuel injection immediately after engine startup commences is performed in a temporary order, since the start operation is performed manually using a recoil starter or a kick starter, the output voltage of the generator changes when the engine starts, and the supply voltage to the injectors is unstable. Therefore, there is a problem in which sufficient fuel is not supplied, and startability deteriorates. Furthermore, since the engine must be started within a limited time while pulling on the rope of the recoil starter, or while giving a kick, in the conventional technique in which fuel is injected in a temporary order, a start operation which drives the generator for a certain period is required. Hence, there is a problem in which there is a load at startup.

Therefore, the present invention has an object of providing an engine start control device and a start control method, that can improve startability.

DISCLOSURE OF INVENTION

In order to solve the above-described problems, the present invention employs the following means.

That is, an engine start control device of the present invention is a engine start control device capable of starting upon receiving generated power from a generator which is driven by a starter, and includes a fuel injection timing setting device which makes a power generation waveform of the generator correspond to a crank pulse signal, and outputs a fuel injection signal to an injector for injecting fuel to the engine in conformance with a crank pulse signal for when a voltage of the generated power reaches a peak value after a starting operation of the starter.

According to this construction, it is possible to inject fuel from the injectors, in conformance with a time when the voltage generated by the generator, which changes cyclically in accordance with the crank pulse signal, reaches a peak. As a result, it is possible to start the engine in a short time after the starting operation, and at a timing where the supply voltage to the injectors reaches a sufficient level.

An engine start control device of the present invention is an engine start control device capable of starting upon receiving power generated from a generator which is driven by a starter, including: an offset time measuring device which measures an offset time of a peak timing of a voltage generated by a generator with respect to a crank pulse signal, immediately after a starting operation of the starter; and a fuel injection timing setting device which outputs a fuel injection signal to an injector for injecting fuel to the engine, after the offset time has elapsed after the crank pulse signal has been output.

According to this construction, the offset time, which is the time difference between the crank pulse signal and the peak timing of the generated voltage, is measured by the offset measuring device. Then by adjustment by the fuel injection timing setting device, when the offset time has elapsed after the crank pulse signal has been output (that is, when the generated voltage reaches a peak), it is possible to inject fuel from the injector. Therefore, it is possible to start the engine in a short time after the starting operation, and at a timing where the supply voltage to the injector reaches a sufficient level.

A start control method for an engine of the present invention is a start control method for an engine capable of starting upon receiving generated power from a generator which is driven by a starter, including injecting fuel from an injector for injecting fuel to the engine, in conformance with a peak timing of a voltage generated by the generator.

According to this method, it is possible to inject a sufficient amount of fuel, and hence it is possible to start the engine reliably.

BEST MODE FOR CARRYING OUT THE INVENTION

Hereunder is a description of an embodiment of an engine start control device and a start control method of the present invention, with reference to the figures.

Figure 1:
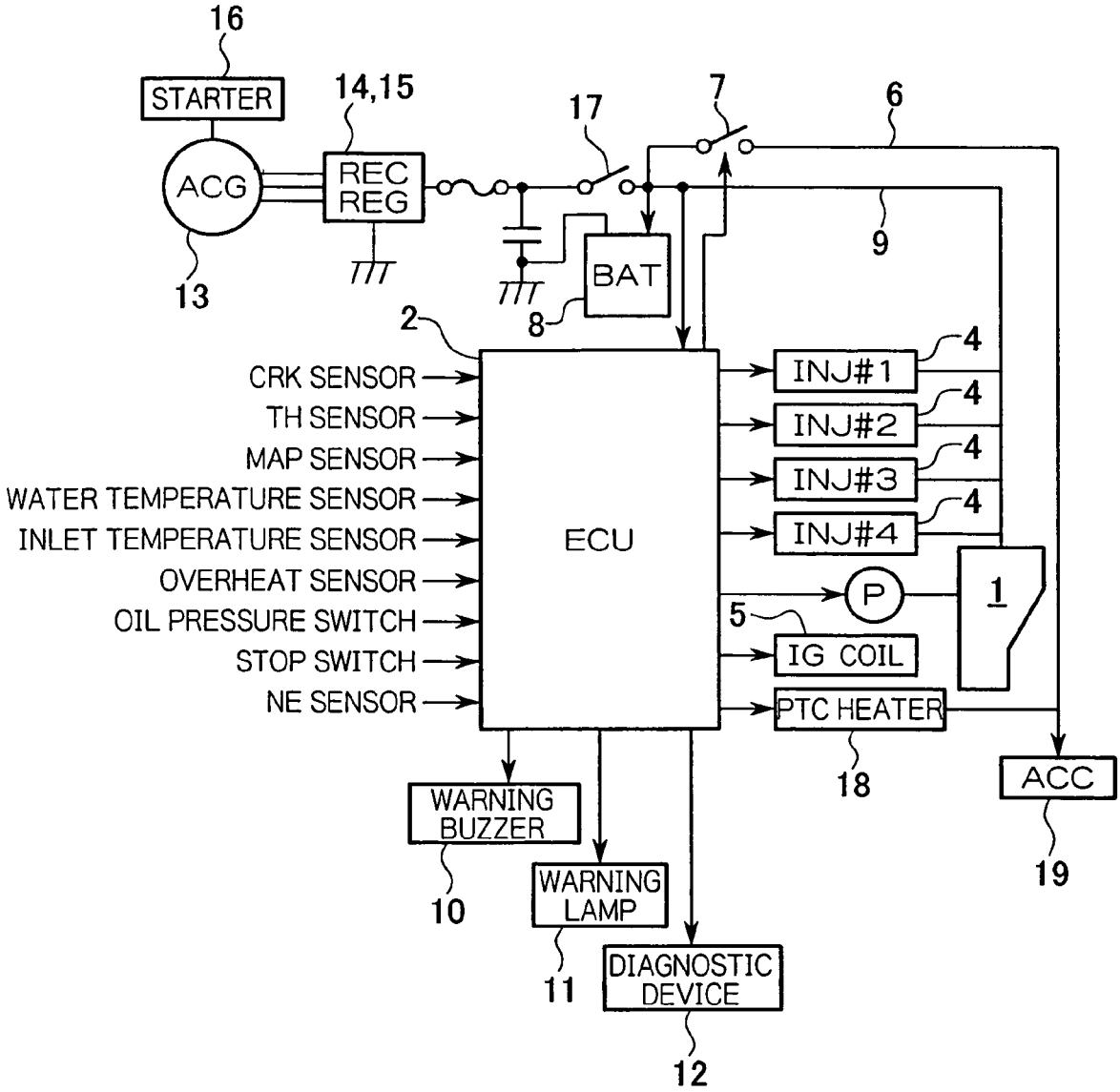
FIG. 1 is a system configuration diagram for an outboard motor which uses an embodiment of an engine start control device and a start control method of the present invention.

FIG. 1 is a system configuration diagram for an outboard motor according to the present embodiment. An engine (not shown in the figure) of an outboard motor 1, has a fuel pump (P) 3 which is driven via an ECU 2. Fuel supplied by the fuel pump 3 is injected by injectors (INJ #1 to 4) 4, ignited by an igniter by energizing an ignition (IG) coil 5, and burned in the cylinders.

The igniter ignites at an optimum crank angle for each cylinder, based on a crank pulse signal. Power is supplied from the battery 8 to the injector 4 in conformance with the ignition timing, to give fuel injection by the injector 4.

The ECU 2, as well as performing control of, the amount of fuel supplied to the injectors 4, the injection timing, and the ignition timing by the ignition coil 5, performs control of a PTC heater 18 for idle control, and open and close control of a relay 7 provided in an accessory circuit 6 for an accessory (ACC) 19 such as a lamp or the like. The ECU 2 includes: a CPU, being a central processing unit for performing a range of calculation processing; a RAM (Random Access Memory) used for storing data partway through the calculations by the CPU; a ROM (Read Only Memory) for storing programs that the CPU executes, tables, maps and the like; and an EEP-ROM (Electronically Erasable and Programmable Read Only Memory) for storing backup data and the like. On receiving power supplied from a power circuit 9 connected to a battery 8, the ECU 2 starts operating.

To the ECU 2A is input signals from; a crank angle (CRK) sensor, a throttle opening (TH) sensor, a MAP sensor for detecting the inlet negative pressure of the engine, a water temperature sensor for detecting the temperature of engine cooling water, an inlet temperature sensor, an overheat sensor, an engine cooling oil pressure switch, a stop switch for emergency stop, and an engine speed (NE) sensor. Moreover, information related to the output voltage of the generator is input from a later mentioned regulator 15. Furthermore, as required, warnings are given by a warning buzzer 10 and a warning lamp 11, and reception and transmission of data to and from a fault diagnosis device 12 is performed.

Reference symbol 13 denotes an electrical generator (ACG). The electrical generator 13 generates electricity at the time of engine drive, and charges the battery (BAT) 8 of the power circuit 9 via a rectifier (REC) 14, and a regulator (REG) 15 for regulating the voltage. The electrical generator 13 also generates electricity in the case of a starting operation by a manual recoil starter 16, and generates starting power for the ECU 2 when the battery capacity is low, which is described later, driving power to the fuel pump (P) 3, and the like. The recoil starter 16 is a starter which starts the engine by a starter rope being pulled. Reference symbol 17 denotes a main switch of the power circuit 9.

Figure 2:
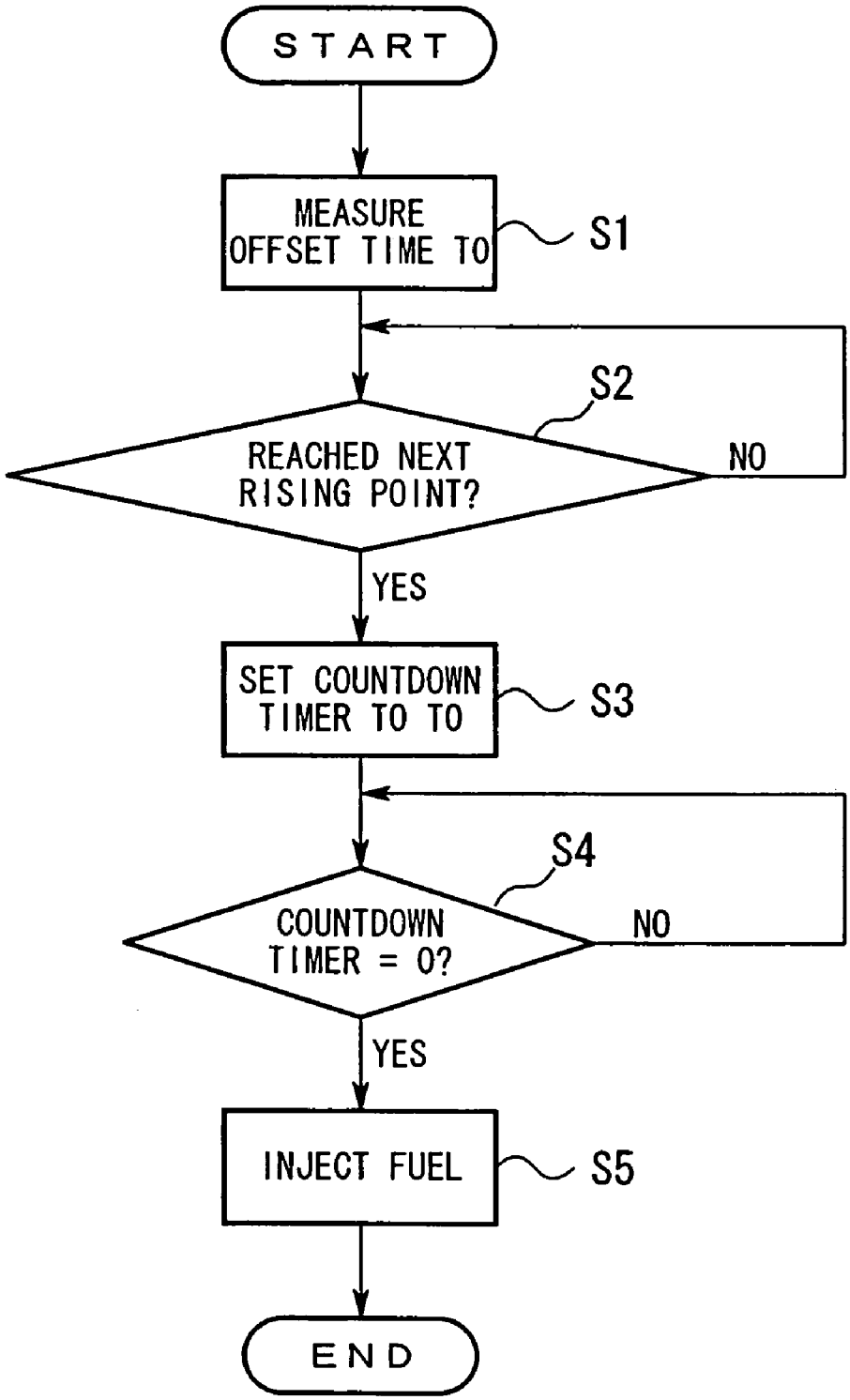
FIG. 2 is a flow chart showing the operation of the start control device.

Next is a description of engine start control based on the flow chart of FIG. 2.

This flow chart shows the processing of the ECU 2 for in the case where starting is performed using the recoil starter 16, in a situation where the battery residual capacity has dropped, or it is cold, so that the necessary voltage cannot be obtained from the battery 8 (when the battery capacity is low).

In FIG. 2, when a starting operation is performed by pulling on a starter rope of the recoil starter 16, in step S1 (offset time measuring device), using the crank pulse signal as a reference, a time difference between the crank pulse signal and the peak of the voltage generated by the generator is measured as an offset time To.

Figure 3:
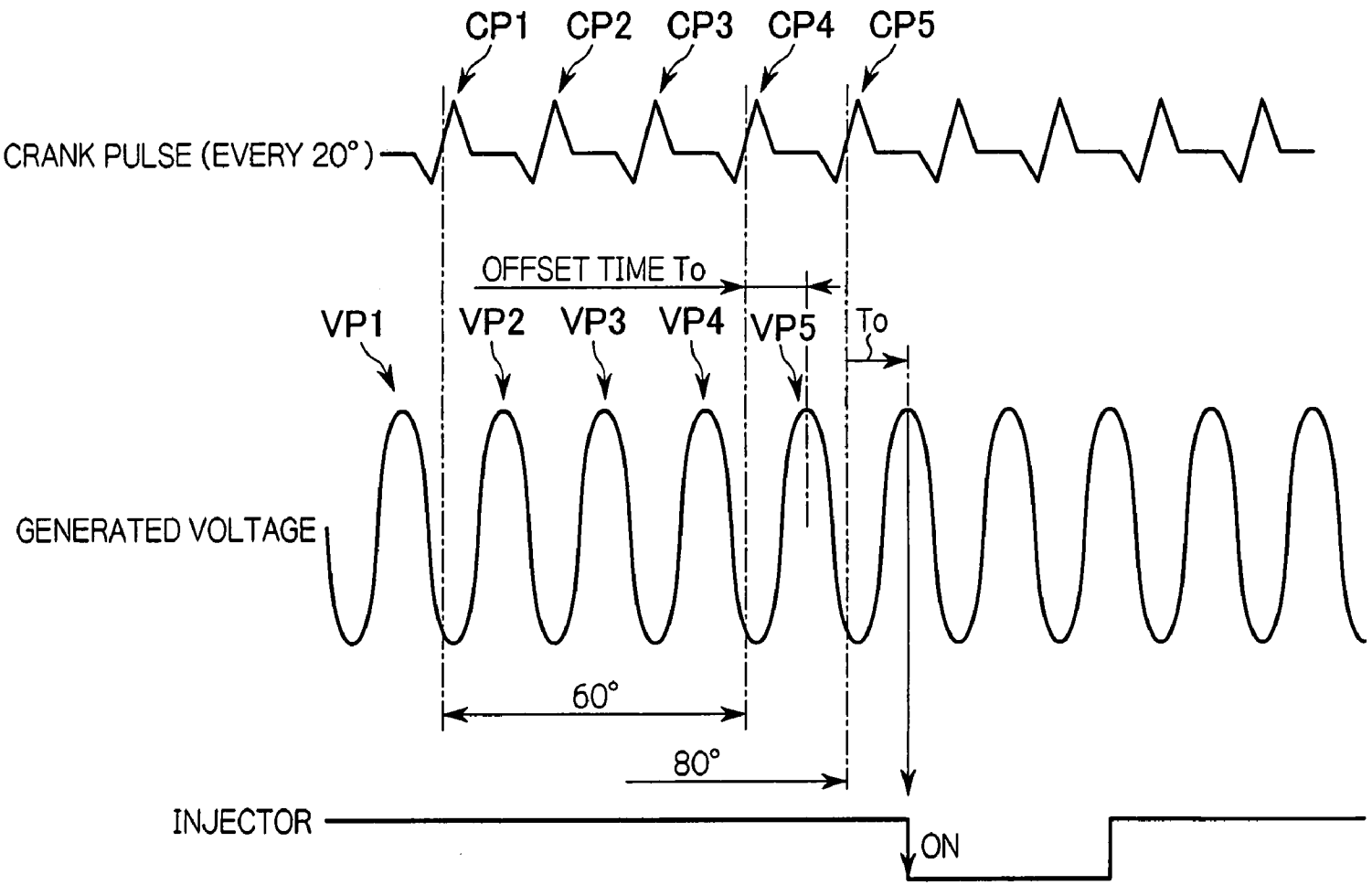
FIG. 3 is a timing chart showing crank pulse signals, generated voltage, and injection timing of an injector.

To be specific, for a charging current armature of the generator 13, a three-phase, 18 electrode type is used, and detecting sections are provided in the flywheel every 20 degrees corresponding to this. That is, when the generator 13 is driven by a starting operation of the recoil starter 16 in a situation in which power cannot be obtained from the battery 8, the generated output voltage from the generator 13 fluctuates widely as shown in FIG. 3. At this time, by matching the cycle of the crank pulse signal with the cycle (power generation wave form) of the voltage generated by the generator 13, it is possible to understand the cycle of the voltage generated by the generator 13, more specifically, the timing at which the generated voltage reaches a peak, with reference to the cycle of the crank pulse signal.

In the case of FIG. 3, the time from a rising point CPn (to be specific, the fourth rising point CP4 (located at 60 degrees)) to the next peak VPm (to be specific, VP5, being the fifth peak) of the generated voltage is measured as an offset time To. For this measurement, the ECU 2 makes a computation immediately after the engine starts, based on an input signal from the crank angle sensor and an input signal from the regulator. Here, n and m=1, 2, 3, 4 (positive integers).

Next, in step S2, it is determined whether or not the rising point CP5 (located at 80 degrees) of the next crank pulse signal is reached. In the case where the determination result is "NO", the flow proceeds again to step S2, while in the case where the determination result is "YES", the flow proceeds to step S3.

In step S3 (fuel injection timing setting device), a countdown timer is set to T0, and the flow proceeds to step S4.

In step S4 (fuel injection timing setting device), it is determined whether the countdown timer=0 or not. In the case where the determination result is "NO", the flow proceeds again to step S4, while in the case where the determination result is "YES", the flow proceeds to step S5. Then in step S5, fuel is injected from the injector 4.

At this time, since the voltage generated by the generator 13 reaches a peak in conformance with the timing for injecting fuel from the injector 4, it is possible to inject fuel in a state where a sufficient fuel injection amount is assured. Therefore, there is no possibility of flameout due to insufficient fuel.

As a result, according to the present embodiment, it is possible to measure the time difference between a crank pulse signal and a peak of the generated voltage, and inject fuel from the injector 4 when the voltage generated by the generator 13 reaches a peak, after the crank pulse signal has been output. Therefore, it is possible to start the engine in a short time after the starting operation, and at the time that the supply voltage to the injector 4 reaches a sufficient level.

Furthermore, since a sufficient amount of fuel can be injected from the injector 4 at a timing in conformance with a peak of the voltage generated by the generator 13, it is possible to start the engine reliably.

The present invention is not limited in the above-described embodiment. For example, in the present embodiment, an outboard motor 1 incorporating a recoil starter 16 is described as an example. However, the invention can also be used for a start control device of a three-wheel, or four-wheel, dune buggy incorporating a kick starter. Furthermore, in the above-described embodiment, the example is given of a case in which a battery 8 and a recoil starter 16 are used together. However, the invention can also be applied to a battery-less situation.

Furthermore, in the present embodiment, an engine start control device of the present invention is realized in which the procedures that are executed in the engine start control device are stored in a computer readable recording medium, and a program stored in this recording medium is read by a computer system for execution. The computer system mentioned here includes an OS (Operating System), and hardware such as peripheral equipment and the like.

Moreover, in the case where a WWW (World Wide Web) system is used, "computer system" also includes a website provider environment (or display environment).

Furthermore, "computer readable recording medium" means a portable medium such as a flexible disc, optical magnetic disc, ROM, CD-ROM, or the like, and memory storage such as a hard disc or the like, built into a computer system. Moreover, "computer readable recording medium" also includes a system where the program is transmitted via a network such as the Internet or the like, or a communication circuit such as a telephone line, or the like, and in which a program is stored temporarily in a volatile memory (RAM) in a computer system, being a client.

Furthermore, the above-described program may be transmitted from a computer system in which the program is stored in memory storage or the like to another computer system via a transmission medium, or by transmitted waves in the transmission medium. Here, "transmission medium" means a medium having a function of transmitting information, such as a network (communication network) such as the Internet, or a communication circuit (communication line) such as a telephone line.

Moreover, the program may realize part of the aforementioned function. Furthermore, it may be a type that can be realized by a combination of the aforementioned function and a program already stored in a computer system, that is, a so-called differential file (differential program).

INDUSTRIAL APPLICABILITY

According to the present invention, it is possible to inject fuel to an injector at the time of a peak of the voltage generated by the generator, which changes cyclically corresponding to a crank pulse signal. Therefore, it is possible to start an engine in a short time after the starting operation, and at a timing where the supply voltage to the injector reaches a sufficient level.

The invention claimed is:

1. An engine start control device capable of starting upon receiving generated power from a generator which is driven by a starter, comprising a fuel injection timing setting device which makes a power generation waveform of said generator correspond to a crank pulse signal, and outputs a fuel injection signal to an injector for injecting fuel to said engine in conformance with a crank pulse signal for when a voltage of said generated power reaches a peak value after a starting operation of said starter.

2. An engine start control device capable of starting upon receiving power generated from a generator which is driven by a starter, comprising:

an offset time measuring device which measures an offset time of a peak timing of a voltage generated by a generator with respect to a crank pulse signal, immediately after a starting operation of said starter; and a fuel injection timing setting device which outputs a fuel injection signal to an injector for injecting fuel to said engine, after said offset time has elapsed after the crank pulse signal has been output.

3. A start control method for an engine capable of starting upon receiving generated power from a generator which is driven by a starter, the method comprising:

measuring an offset time of a peak timing of a voltage generated by a generator with respect to a crank pulse signal, immediately after a starting operation of said starter; and outputting a fuel injection signal to an injector for injecting fuel to said engine, after said offset time has elapsed after the crank pulse signal has been output.

* * * * *